US011620867B2

(12) United States Patent
Farooq et al.

(10) Patent No.: US 11,620,867 B2
(45) Date of Patent: Apr. 4, 2023

(54) DOOR ACTUATION SYSTEM USING CONTACTLESS BRAINWAVE MONITORING AND GAIT RECOGNITION

(71) Applicant: TOYOTA MOTOR ENGINEERING & MANUFACTURING NORTH AMERICA, INC., Plano, TX (US)

(72) Inventors: Muhamed K. Farooq, Ann Arbor, MI (US); Ercan Mehmet Dede, Ann Arbor, MI (US); Frederico Marcolino Quintao Severgnini, Ann Arbor, MI (US)

(73) Assignee: TOYOTA MOTOR ENGINEERING & MANUFACTURING NORTH AMERICA, INC., Plano, TX (US)

( * ) Notice: Subject to any disclaimer, the term of this patent is extended or adjusted under 35 U.S.C. 154(b) by 0 days.

(21) Appl. No.: 17/208,307

(22) Filed: Mar. 22, 2021

(65) Prior Publication Data

US 2022/0301375 A1 Sep. 22, 2022

(51) Int. Cl.

| | |
|---|---|
| ***G07C 9/25*** | (2020.01) |
| ***G07C 9/00*** | (2020.01) |
| ***G07C 9/23*** | (2020.01) |

(52) U.S. Cl.

CPC ..... *G07C 9/25* (2020.01); *G07C 9/00571* (2013.01); *G07C 9/23* (2020.01)

(58) Field of Classification Search

CPC ..... G07C 9/25; G07C 9/00571; G07C 9/23; G07C 9/37; G07C 9/26; G07C 9/00563;

(Continued)

(56) References Cited

U.S. PATENT DOCUMENTS 6,801,640 B1 * 10/2004 Okubo ..... G07C 9/00 340/5.2

10,304,275 B2 5/2019 Dyne et al.

(Continued)

FOREIGN PATENT DOCUMENTS

CN 203250345 U 10/2013
CN 205302426 U 6/2016

(Continued)

OTHER PUBLICATIONS

Anne Manning, "Brainy students use brain waves to control lights, open doors", Colorado State University—Responsive Signature Graphic, https://source.colostate.edu/brainy-students-use-brain-waves-control-lights-open-doors/, Apr. 12, 2016, 5 pages.

*Primary Examiner* — Mohamed Barakat

(74) *Attorney, Agent, or Firm* — Oblon, McClelland, Maier & Neustadt, L.L.P.

(57) ABSTRACT

The present disclosure is related to utilizing contactless brainwave detectors to gather a user's unique electroencephalogram (EEG) data. EEG data, as well as an additional biometric, such as gait, can be used to determine whether users have access to enter a locked system, such as a door. An access list can be created and pre-registered with the EEG data and any additional biometric data of users who have access to enter the locked system. As the user nears the locked system, they can generate the EEG data to unlock the locked system by thinking of a pre-registered password stored in the access list.

15 Claims, 12 Drawing Sheets

(58) Field of Classification Search
CPC .. G07C 2209/63; G07C 9/28; G07C 2209/14; G06F 3/015; G06F 21/32; G06F 21/40; G06V 40/70; G06V 40/25; G08B 21/0446
USPC ..... 340/5.53, 5.54, 5.52
See application file for complete search history.

(56) References Cited

U.S. PATENT DOCUMENTS

2004/0097824 A1* 5/2004 Kageyama ..... B60R 16/0231 340/4.1
2004/0201450 A1* 10/2004 Samburg ..... G07C 9/20 340/5.2
2007/0001835 A1* 1/2007 Ward ..... G07C 9/28 340/522
2009/0295534 A1* 12/2009 Golander ..... G07C 9/28 340/5.2
2010/0164680 A1* 7/2010 Yancey ..... G07C 9/27 340/5.82
2015/0308706 A1* 10/2015 Bunker ..... G05B 15/02 700/275
2015/0338917 A1* 11/2015 Steiner ..... H04L 9/3271 345/156
2016/0071343 A1* 3/2016 Agrafioti ..... H04W 12/068 340/5.52
2017/0311831 A1* 11/2017 Freer ..... A61B 5/18
2019/0122475 A1* 4/2019 Dyne ..... G07C 9/10
2020/0356170 A1* 11/2020 An ..... B60K 37/06
2021/0031778 A1* 2/2021 Farooq ..... B60K 28/02

FOREIGN PATENT DOCUMENTS

CN 206668035 U 11/2017
CN 107503626 A 12/2017
CN 106223776 B 4/2018
CN 210118044 U 2/2020
KR 10-1769473 B1 8/2017
KR 10-2031958 B1 10/2019
WO WO 2017/031848 A1 3/2017
WO WO 2019/206253 A1 10/2019

* cited by examiner

DOOR ACTUATION SYSTEM USING CONTACTLESS BRAINWAVE MONITORING AND GAIT RECOGNITION

BACKGROUND

Identification and authentication for access control is a field of ever growing importance. Allowing unauthorized access into a system can leave it vulnerable to a myriad of negative consequences.

Although previous identification and authentication systems exist, they are not without their flaws. For example, systems relying on keys or manually entered passwords can be compromised when a user forgets their key or password, or when it falls into the hands of an unauthorized user. As another example, fingerprint or iris recognition can be used to secure locked systems, but these systems can be compromised as a user's iris ages, or their finger is cut or worn-out.

In light of the above mentioned problems, there continues to exist a need for alternative access control techniques. There exists a need for securely identifying individuals, and ensuring that only authorized individuals can access otherwise locked systems.

SUMMARY

The present disclosure is related to an access control method comprising: gathering electroencephalogram (EEG) data of a user using one or more brainwave detectors; gathering secondary biometric data of the user using one or more sensors; determining whether the user is in an access list using at least one of the EEG data and the secondary biometric data, wherein the access list includes pre-registered EEG data and pre-registered secondary biometric data of authorized users that can unlock a locked system, and wherein the user is in the access list if at least one of the EEG data and the secondary biometric data match the pre-registered EEG data and the pre-registered secondary biometric data of an authorized user; and in a case that the user is in the access list, unlocking the locked system.

In one exemplary embodiment, the method further comprises showing the user one or more images to generate the EEG data.

In one exemplary embodiment, the method further comprises, in a case that the user is not in the access list, signaling an alert.

In one exemplary embodiment, the brainwave detectors are contactless brainwave detectors.

In one exemplary embodiment, the secondary biometric data includes gait data of the user's gait.

In one exemplary embodiment, the one or more sensors includes at least one of a fingerprint sensor, pressure sensor, imaging sensor, and distance sensor.

In one exemplary embodiment, the locked system includes a door.

In one exemplary embodiment, the locked system includes a door and the one or more brainwave detectors are placed adjacent to the door.

In one exemplary embodiment, the locked system includes a door and the one or more brainwave detectors are placed on one or more walls or ceilings leading up to the door.

The present disclosure is also related to a locked system comprising: processing circuitry configured to gather EEG data of a user using one or more brainwave detectors, gather secondary biometric data of the user using one or more sensors, determine whether the user is in an access list using at least one of the secondary biometric data and the EEG data, wherein the access list includes pre-registered EEG data and pre-registered secondary biometric data of authorized users that can unlock the locked system, and wherein the user is in the access list if at least one of the EEG data and the secondary biometric data match the pre-registered EEG data and the pre-registered secondary biometric data of an authorized user, and in a case that the user is in the access list, unlock the locked system.

In one exemplary embodiment, the processing circuitry is further configured to show the user one or more images to generate the EEG data.

In one exemplary embodiment, the processing circuitry is further configured to, in a case that the user is not in the access list, signal an alert.

In one exemplary embodiment, the brainwave detectors are contactless brainwave detectors.

In one exemplary embodiment, the secondary biometric data includes gait data of the user's gait.

In one exemplary embodiment, the one or more sensors includes at least one of a fingerprint sensor, pressure sensor, imaging sensor, and distance sensor.

In one exemplary embodiment, the locked system includes a door.

In one exemplary embodiment, the locked system includes a door and the one or more brainwave detectors are placed adjacent to the door.

In one exemplary embodiment, the locked system includes a door and the one or more brainwave detectors are placed on one or more walls or ceilings leading up to the door.

The present disclosure is also related to an access control method comprising: gathering location data from each user of a plurality of users using one or more sensors; gathering EEG data from each user of the plurality of users using one or more contactless brainwave detectors; gathering secondary biometric data from each user of the plurality of users using the one or more sensors; and assigning each of the EEG data and each of the secondary biometric data to each user of the plurality of users using the location data.

In one exemplary embodiment, the method further comprises determining, based on the assigning, whether each of the plurality of users is in an access list, wherein the access list includes pre-registered EEG data and pre-registered secondary biometric data of authorized users that can unlock a locked system, and wherein a user from the plurality of users is determined to be in the access list if at least one of the EEG data and the secondary biometric data gathered from the user match the pre-registered EEG data and the pre-registered secondary biometric data of an authorized user; and in a case that a number of the plurality of users determined to be in the access list exceeds a predetermined threshold, unlocking the locked system.

DETAILED DESCRIPTION

Figure 1:
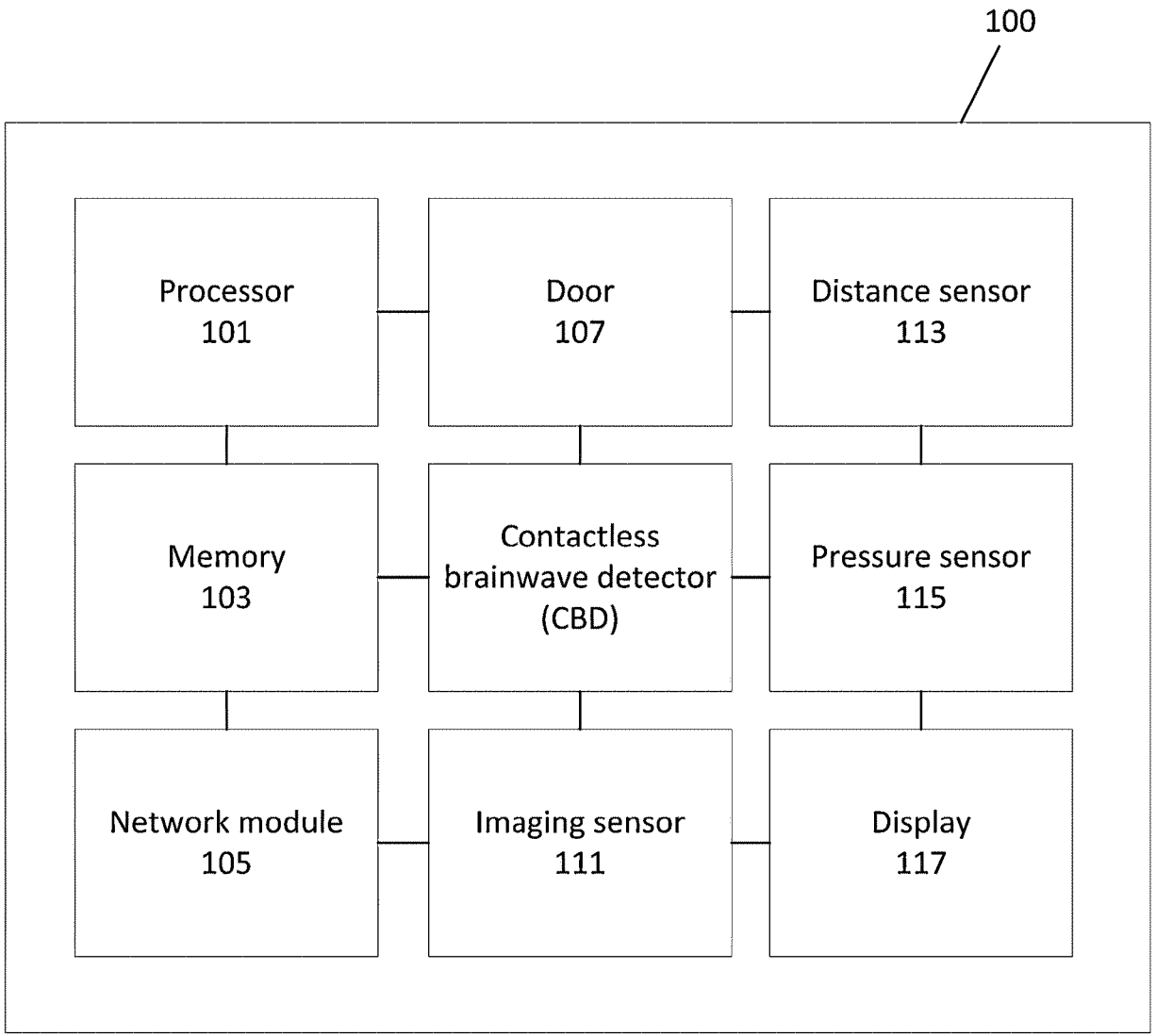
FIG. 1 is a system diagram of a locked system, according to one exemplary aspect of the present disclosure.

The readings of how a brain reacts to certain words or tasks are unique to each individual. As a result, brainwave activity can be utilized as a biometric for identification and authentication. Electroencephalogram (EEG) can be used to record each individual's unique electrical activity of the brain. Previously, contact sensors were used for reading brainwaves (e.g. electrodes attached onto a user's scalp), but there now exists contactless sensors for monitoring and recording brainwave activity. For instance, brainwave detectors can utilize neurobiomonitoring (NBM) for real-time, contactless brainwave detection. As a result, each user's unique EEG data can be obtained in a contactless manner and utilized for identifying and authenticating their identity. In one embodiment, identification can be granting access to a registered user, and authentication can be making sure the same registered user is still in the system.

Furthermore, multimodal biometric systems use multiple biometrics to overcome limitations of unimodal biometric systems. Because it is unlikely that multiple unimodal biometric systems suffer from the same limitations, multimodal biometric systems can fuse multiple unimodal biometric systems together to mitigate each other's deficiencies.

One example of another biometric system is gait detection, since every user's gait is unique. Gait detection includes monitoring and identifying a user based on their gait. This gait monitoring can be accomplished in a myriad of ways, such as analyzing readings from sensors on a user's body or clothes, video analysis using gait-reading algorithms, or analyzing readings from pressure sensors on the floor. Other examples of biometrics include facial recognition, fingerprints, finger geometry (the size and position of fingers), iris recognition, vein recognition, retina scanning, voice recognition, DNA (deoxyribonucleic acid) matching, digital signatures, smell, height, weight, and behavioral profiling.

The present disclosure relates to using EEG data and secondary biometric data, such as gait, to determine whether a user is allowed to access an otherwise locked system, such as a door. Contactless brainwave detectors (CBDs), such as an NBM sensor, can be strategically placed (e.g. above a door, on a ceiling, along a wall) to gather EEG data of one or more users trying to access the locked system. In another embodiment, the brainwave detectors do not have to be contactless. For example, an electrode cap can be placed near a locked door for a user to wear during EEG data collection. Furthermore, additional sensors can be used to gather secondary biometric data. The gathered EEG data and secondary biometric data are then compared to an access list containing the pre-registered EEG data and pre-registered secondary biometric data of users who are authorized to unlock the locked system. A user is said to be "in an access list" or "in the access list" if at least one of their gathered EEG data and secondary biometric data match the pre-registered EEG data and/or pre-registered secondary biometric data of a user profile of an authorized user in the access list. The techniques mentioned in the present disclosure work when there is one user or multiple users. In the case where there are multiple users (i.e. multiple EEG readings), the location of each user can be determined and utilized for attributing each of the different EEG readings to their source user.

FIG. 1 shows a locked system 100 according to one exemplary aspect of the present disclosure. The processor 101 can be configured to perform various steps of method 800, 900, and 1000 described herein and variations thereof. The processor 101 can include a CPU that can be implemented as discrete logic gates, as an Application Specific Integrated Circuit (ASIC), a Field Programmable Gate Array (FPGA) or other Complex Programmable Logic Device (CPLD). An FPGA or CPLD implementation may be coded in VHDL, Verilog, or any other hardware description language and the code may be stored in an electronic memory directly within the FPGA or CPLD, or as a separate electronic memory.

Further, the memory 103 may be non-volatile, such as ROM, EPROM, EEPROM or FLASH memory. The memory 103 can also be volatile, such as static or dynamic RAM, and a processor, such as a microcontroller or microprocessor, may be provided to manage the electronic memory as well as the interaction between the FPGA or CPLD and the memory. The memory 103 can be a hard disk drive, CD-ROM drive, DVD drive, FLASH drive, RAM, ROM or any other electronic storage known in the art. In one embodiment, the access list is stored in the memory 103.

Alternatively, the CPU in the processor 101 can execute a computer program including a set of computer-readable instructions that perform various steps of methods 800, 900, and 1000 described herein and variations thereof, the program being stored in any of the above-described non-transitory electronic memories and/or a hard disk drive, CD, DVD, FLASH drive or any other known storage media. Further, the computer-readable instructions may be provided as a utility application, background daemon, or component of an operating system, or combination thereof, executing in conjunction with a processor, such as a Xeon processor from Intel of America or an Opteron processor from AMD of America and an operating system, such as Microsoft VISTA, UNIX, Solaris, LINUX, Apple, MAC-OS and other operating systems known to those skilled in the art. Further, CPU can be implemented as multiple processors cooperatively working in parallel to perform the instructions.

The network module 105, such as an Intel Ethernet PRO network interface card from Intel Corporation of America, can interface between the various parts of the locked system 100. Additionally, the network module 105 can also interface with an external network. As can be appreciated, the external network can be a public network, such as the Internet, or a private network such as an LAN or WAN network, or any combination thereof and can also include PSTN or ISDN sub-networks. The external network can also be wired, such as an Ethernet network, or can be wireless such as a cellular network including EDGE, 3G and 4G wireless cellular systems. The wireless network can also be WiFi, Bluetooth, or any other wireless form of communication that is known. In one embodiment, the network module 105 can be used to access an access list stored on a network.

The door 107 can include a lock for locking and unlocking the door 107. The door 107 can receive the command to lock or unlock from the processor 101.

The contactless brainwave detector (CBD) can include an array of one or more CBDs. The CBDs can be configured in various different ways to collect EEG data most appropriate for a given situation, as can be appreciated by one or skill in the art. For instance, CBDs can be placed on the door 107, adjacent to the door 107 (e.g. above the door, next to the door), on one or more walls leading up to the door 107, on a ceiling, or any combination thereof.

The imaging sensor 111, distance sensor 113, and pressure sensor 115 can be used to collect additional data on one or more users, such as their gait or location. In one embodiment, the imaging sensor 111 can be a camera. In one embodiment, the distance sensor 113 can be a LIDAR sensor, ultrasonic sensor, or infrared sensor. In one embodiment, the pressure sensor 115 is in a floor leading up to the door and can sense characteristics such as a user's weight, foot size, walking speed, stride length, and so on.

In one implementation, additional information can be displayed on the display 117. The display 117 can be an LCD display, CRT display, plasma display, OLED, LED or any other display known in the art. The display 117 can also have speakers for emitting audio. In one embodiment, the display 117 can display one or more images to a user to generate EEG data. The same one or more images can be displayed to the user as that when the user first set up their password in the access list. The one or more icons can be displayed at particular frequencies. For instance, three images can be shown at three different frequencies. As was the case with the CBDs, the display 117 can be placed in various locations, such as near the door 107 or on a wall. Furthermore, the display 117 can be used to provide feedback to a user, such as an alert that a user is not in an access list, or a command to stand still near a CBD until the EEG data is collected.

Figure 2:
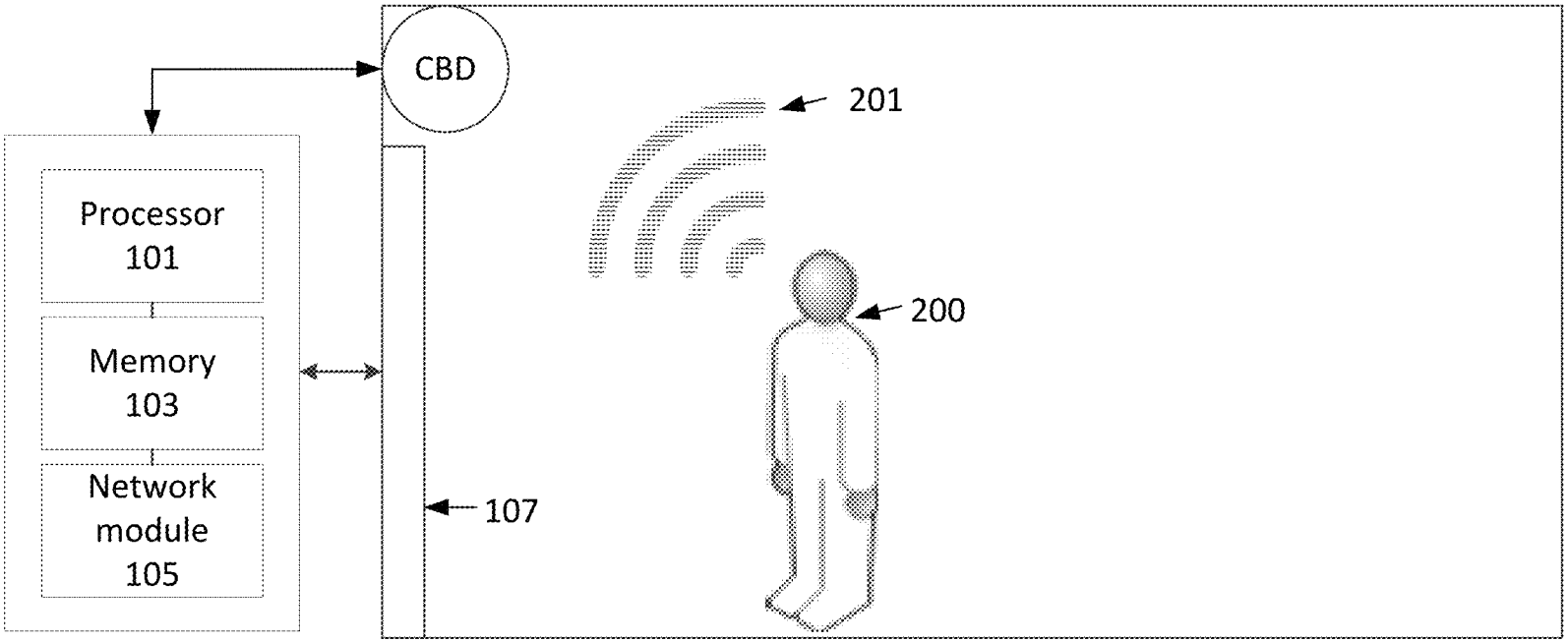
FIG. 2 is a first scenario for entering a locked system using a contactless brainwave detector (CDB) arranged adjacent to a door, according to one exemplary aspect of the present disclosure.

FIG. 2 through FIG. 7 illustrate several scenarios, and will be used to facilitate discussion on additional exemplary embodiments. In FIG. 2, a user 200 walks up to a locked door 107. As the user 200 nears the door, they think of a password, such as a repetitive phrase, task, or mathematical equation. A CBD placed near the door detects the EEG waves 201 emitted from the user 200, and sends the EEG data to the processor 101. The processor 101 can analyze the EEG data to determine whether it is in an access list. If the extracted EEG signature matches an EEG signature profile in the access list, the door 107 can unlock for the user 200 to enter. If the collected EEG data is not in the access list, the door 107 can remain locked.

Regarding the access list, users will need to pre-register their specific EEG password into the access list before trying to unlock the door. Thereafter, identification and authorization of the user can be determined by referencing their collected EEG data with an access list, such as a user registry, database, or lookup table. In one embodiment, the access list can be stored in the processor 101, memory 103, or a network accessible via the network module 105 (e.g. cloud).

Figure 3:
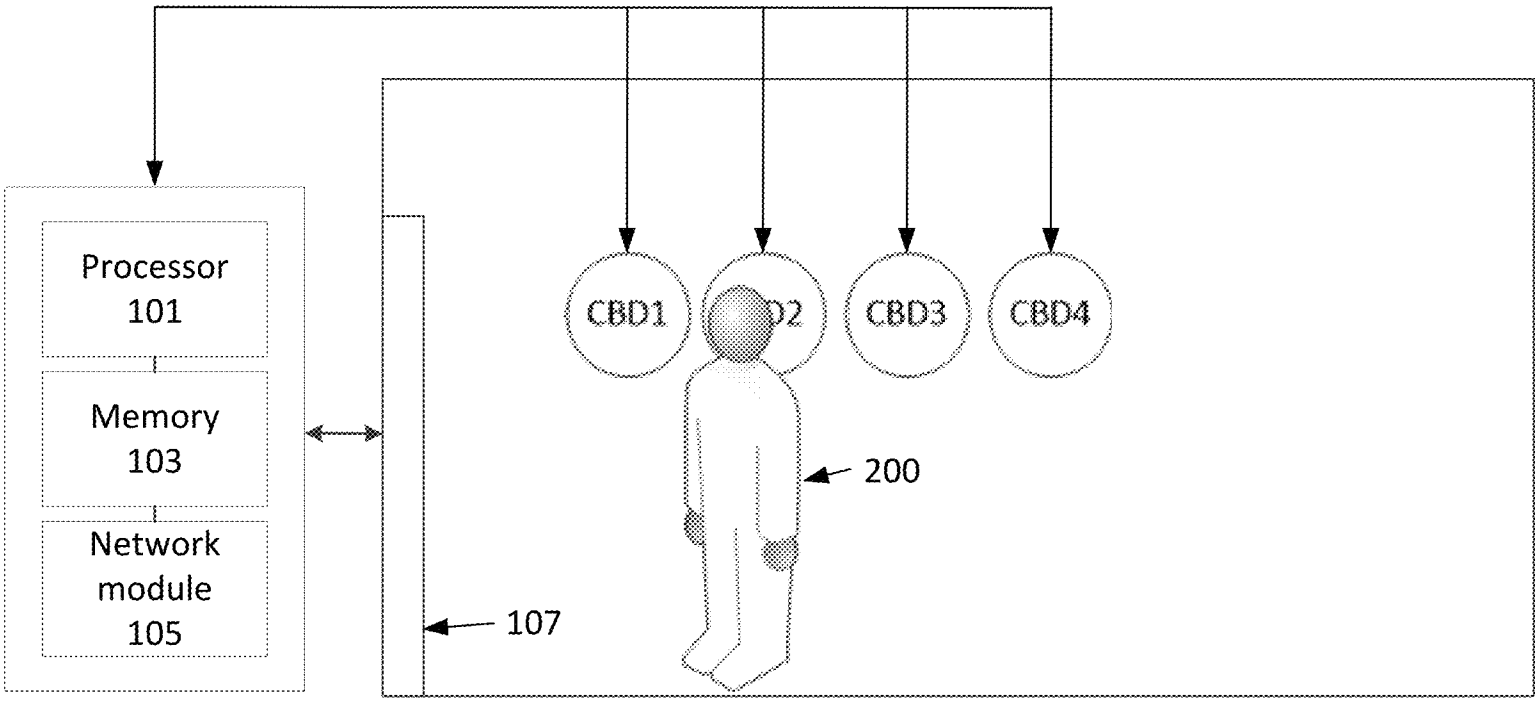
FIG. 3 is a second scenario for entering a locked system using an array of CBDs arranged along a wall leading up to a door, according to one exemplary aspect of the present disclosure.

As was previously mentioned, various arrangements of CBDs can be used. For instance, as shown in FIG. 3, an array of four CBDs, CBD1-CBD4, are placed along one side of a wall. As the user 200 walks closer to the door 107, the array of CBDS can work independently or in tandem to collect the user's 200 EEG data. For example, CBD4 can collect a first portion of EEG data, CBD3 a subsequent second portion of EEG data, CBD2 a subsequent third portion of EEG data, and CBD1 a final fourth portion of EEG data, where each of the four portions of EEG data can then be serially combined. The array of CBDs can be placed at consistent distances from each other, or in any other unique pattern for efficiently gathering a user's EEG data and sending it to the processor 101. If the EEG data collected by the CBDs matches an EEG signature profile in the access list, the door 107 can unlock. If the EEG data is not in the access list, the door 107 can remain locked.

Figure 4:
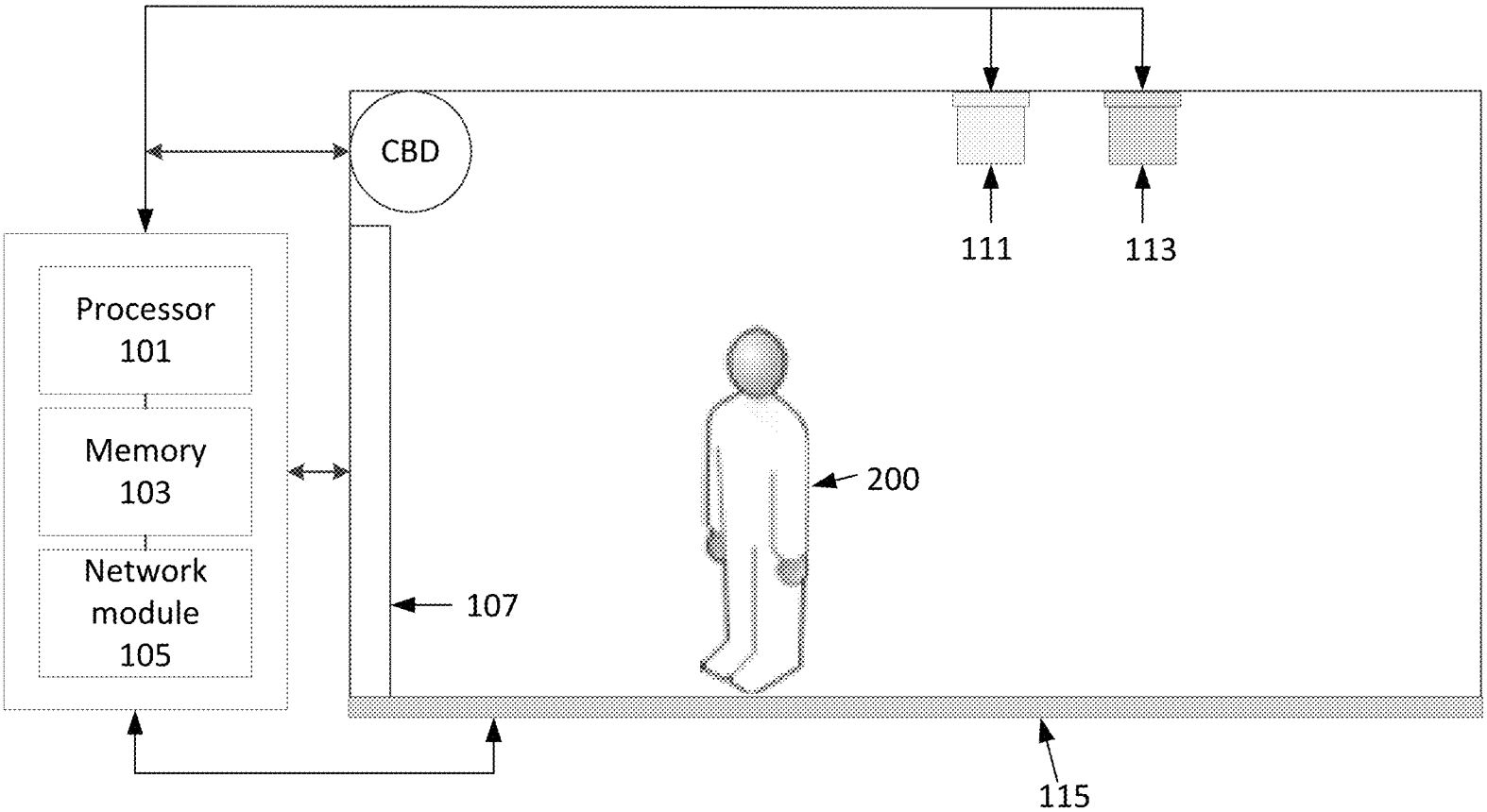
FIG. 4 is a third scenario for entering a locked system that includes gathering secondary biometric data, according to one exemplary aspect of the present disclosure.

FIG. 4 illustrates another exemplary embodiment, where, in addition to gathering EEG data using CBDs, one or more sensors are used to gather secondary biometric data of the user 200. In this exemplary embodiment, a pressure sensor 115, imaging sensor 111, and distance sensor 113 are used to collect gait data of the user 200. The gait data can be collected and analyzed using techniques known by those of skill in the art in gait tracking and analysis. The collected EEG data and gait data can be referenced to the access list to determine whether the user 200 can unlock the door 107. As was the case for the EEG data, users will need to pre-register their specific gait data into the access list before trying to unlock the door 107. In one exemplary embodiment, both the EEG data and secondary biometric data of the user 200 must match pre-registered EEG data and pre-registered secondary biometric data of a user profile in the access list for the door 107 to unlock. In another exemplary embodiment, either the EEG data or gait data of the user 200 must match pre-registered EEG data or pre-registered secondary biometric data of a user profile in the access list for the door 107 to unlock. It can be appreciated that other types of secondary biometric data and their respective sensors can be used instead of or in addition to gait data, such as fingerprint sensors for reading fingerprints, or iris sensors for collecting iris data. Moreover, a user can pre-register a specific gesture into the access list to act as an additional password.

Figure 5A:
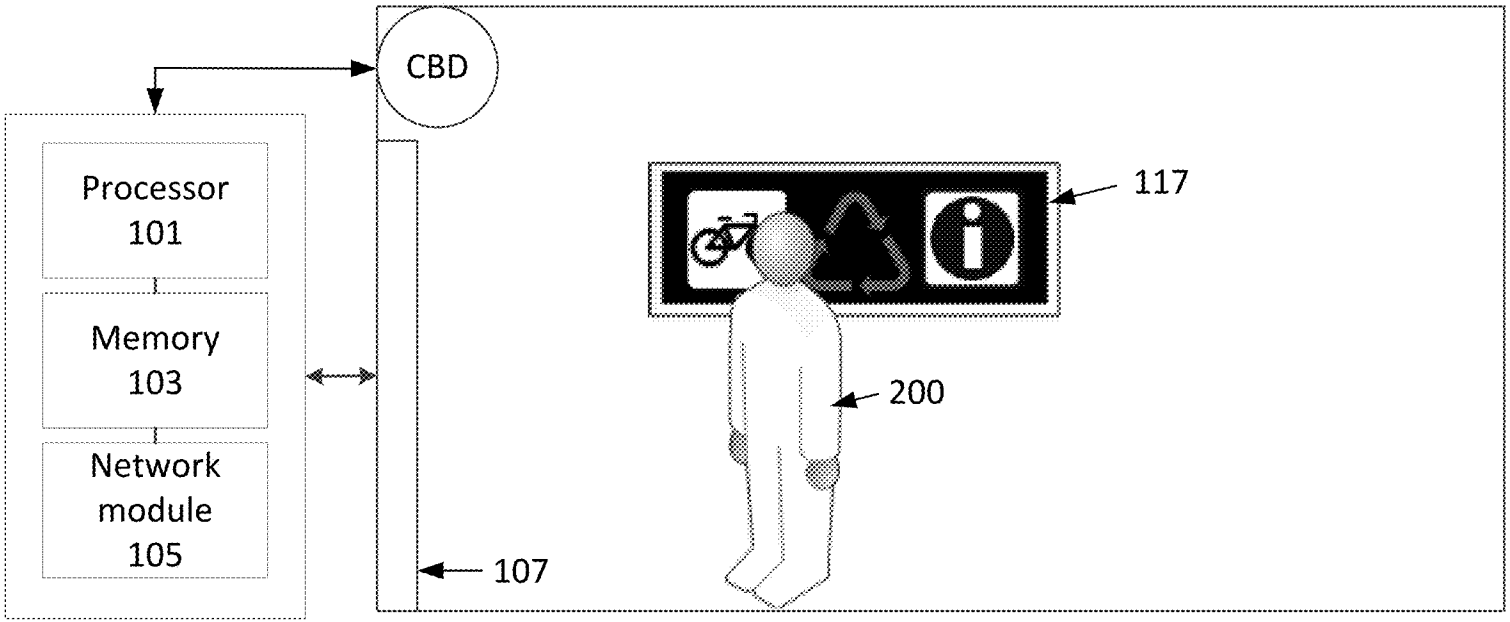
FIG. 5A is a fourth scenario for entering a locked system that includes a display, according to one exemplary aspect of the present disclosure.
Figure 5B:
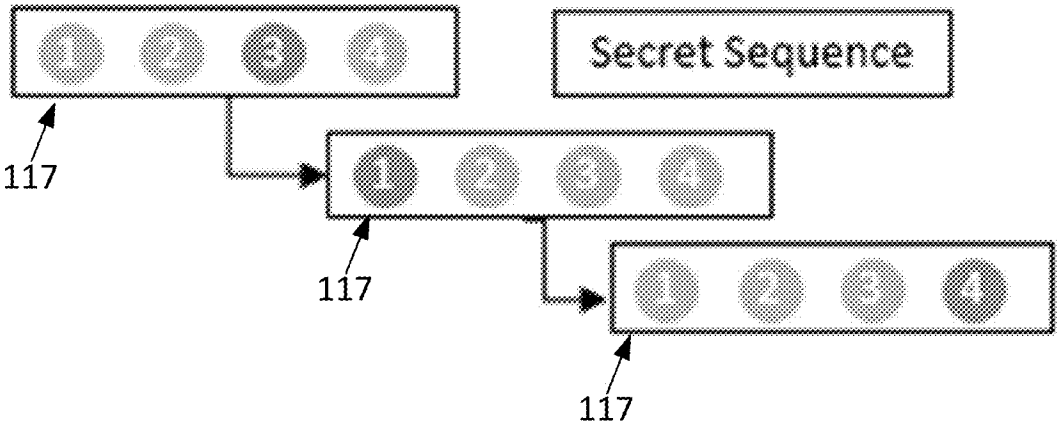
FIG. 5B is an example of viewing a series of images in a secret sequence for generating a particular EEG pattern, according to one exemplary aspect of the present disclosure.

According to one exemplary embodiment, as shown in FIG. 5A, the EEG data can be collected as a user 200 looks at one or more images on the display 117, the one or more images each oscillating at a specific frequency. Because each brain's response to an image is unique to that user, the one or more images can serve to generate the user's EEG data representing their password. Even if a different user looks at the same images, their EEG signature will be different. The password can be an authorized user's EEG data collected from looking at one image, or a series of images in a secret sequence. For instance, as shown in FIG. 5B, four images at four different frequencies can be shown on the display 117. In this example, an authorized user knows that they have to look at image 3, 1, and 4 (in that specific sequence) to generate the EEG data for unlocking the door 107. In other words, security relies on not only the EEG signature of the user 200, but also the secret sequence that needs to be reproduced.

Figure 6A:
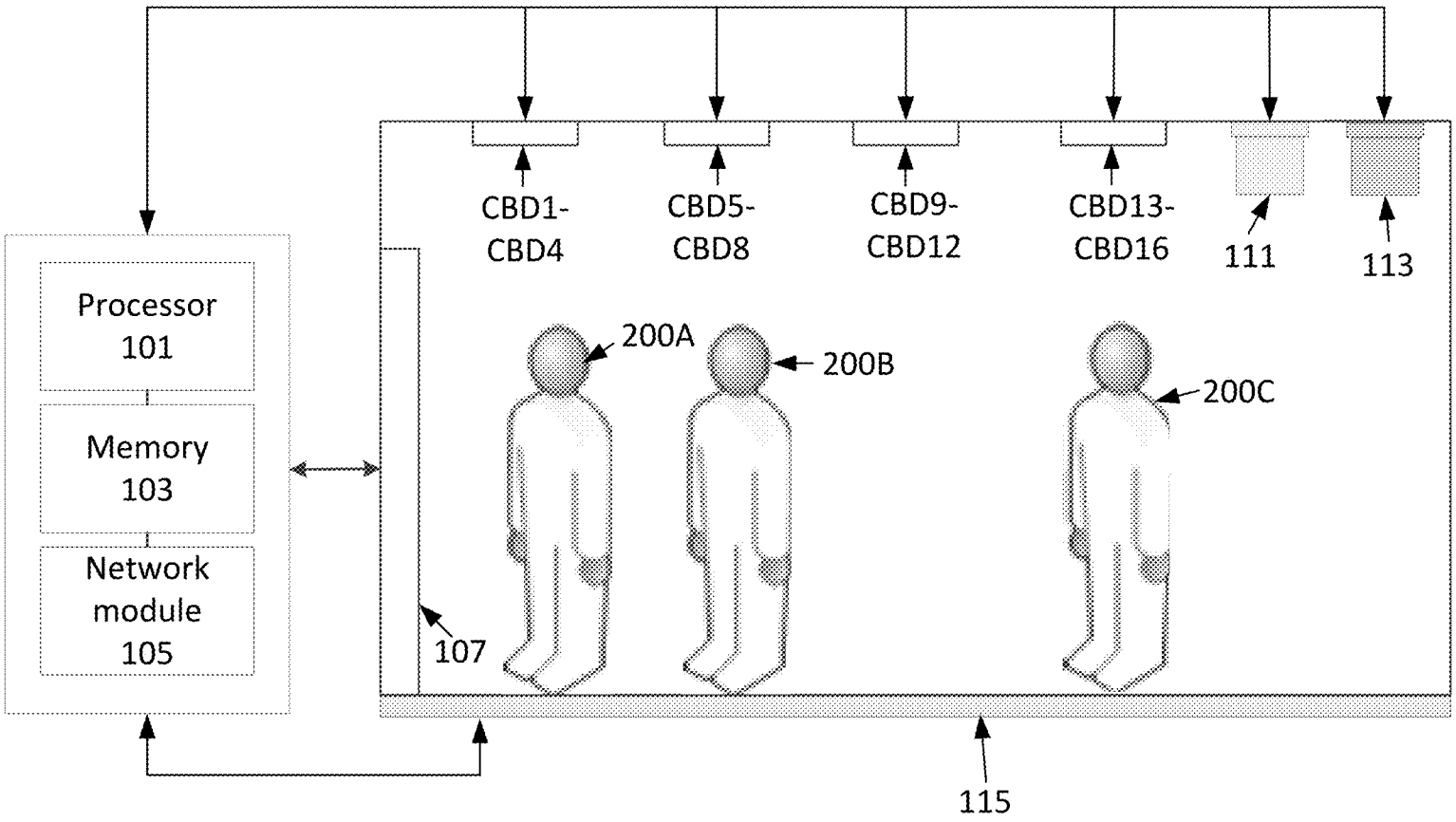
FIG. 6A is a fifth scenario for entering a locked system using an array of CBDs arranged along a ceiling, according to one exemplary aspect of the present disclosure.
Figure 6B:
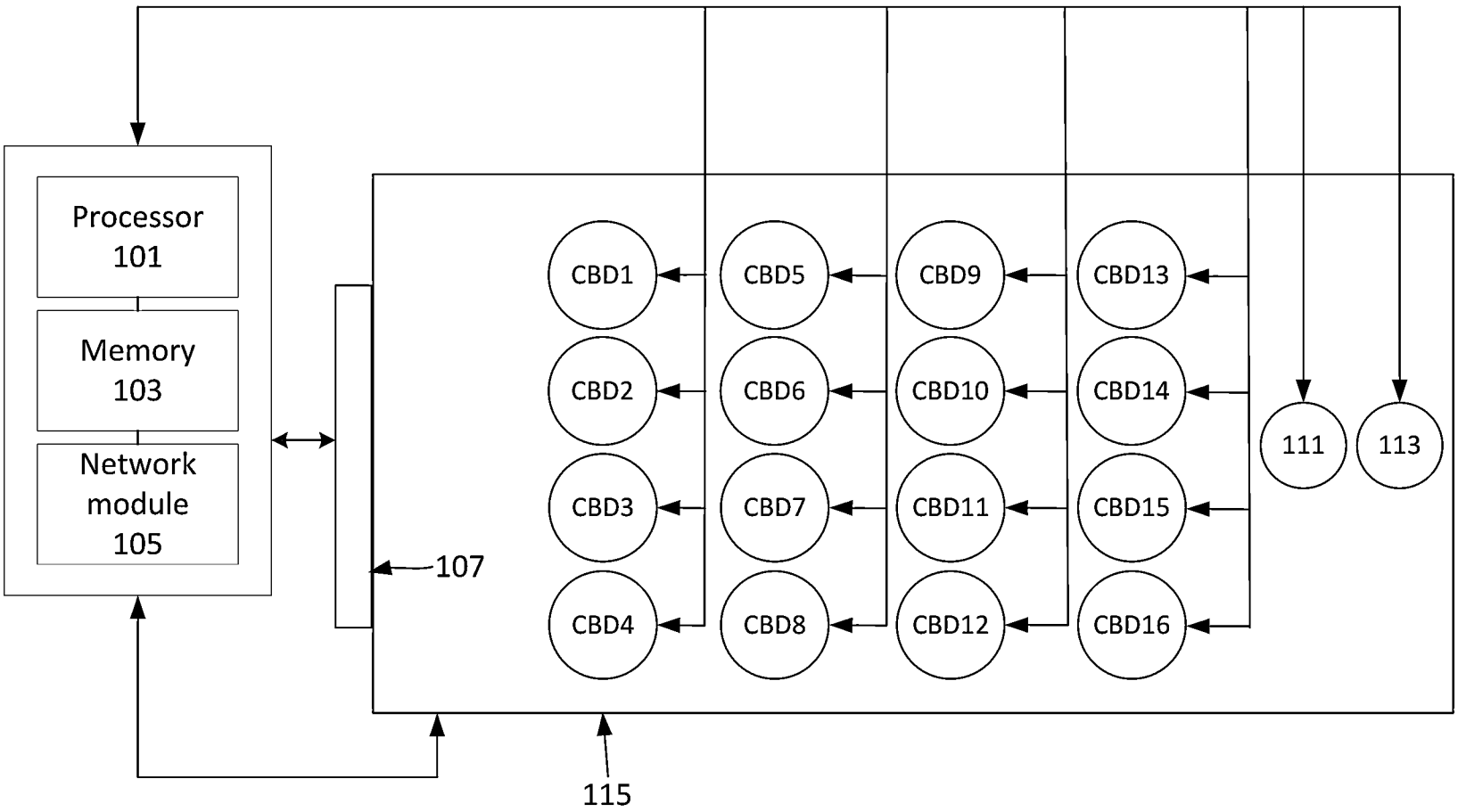
FIG. 6B is an additional view of the CBDs arranged along the ceiling, according to one exemplary aspect of the present disclosure.

The present disclosure also enables secure identification and authorization in the presence of multiple people. For instance, as shown in FIG. 6A, CBDs 1-16 can be placed along a ceiling to collect EEG data from multiple users 200A, 200B, 200C. FIG. 6B shows another view of CBD1-CBD16 placed as an array on the ceiling. In one embodiment, the CBD closest to each user can be used to collect EEG data. A single CBD can be used to collect the EEG data of a user, or multiple CBDs can work in tandem to collect EEG data of a user, as described in FIG. 3. The door 107 can unlock if the amount of users determined to be in the access list exceed a predetermined threshold. In one exemplary embodiment, the door 107 unlocks when the number of users in the access list is greater than zero (e.g. at least one of user 200A, 200B, or 200C is in the access list). In another exemplary embodiment, the door 107 unlocks if 100% of the users are in the access list (e.g. 200A, 200B, and 200C are all in the access list).

Secondary biometric data can also be collected and used for the identifying and authorizing process when there are multiple users. For example, similar to the situation describe in FIG. 4, a pressure sensor 115, imaging sensor 111, distance sensor 113, or any combination thereof can be used to identify and verify each user 200A, 200B, 200C by their gait. Furthermore, these sensors can be used to identify a location of each user 200A, 200B, 200C, where this location data can be used to assign the different datasets of EEG data and secondary biometric data to the corresponding user who produced it.

Figure 7:
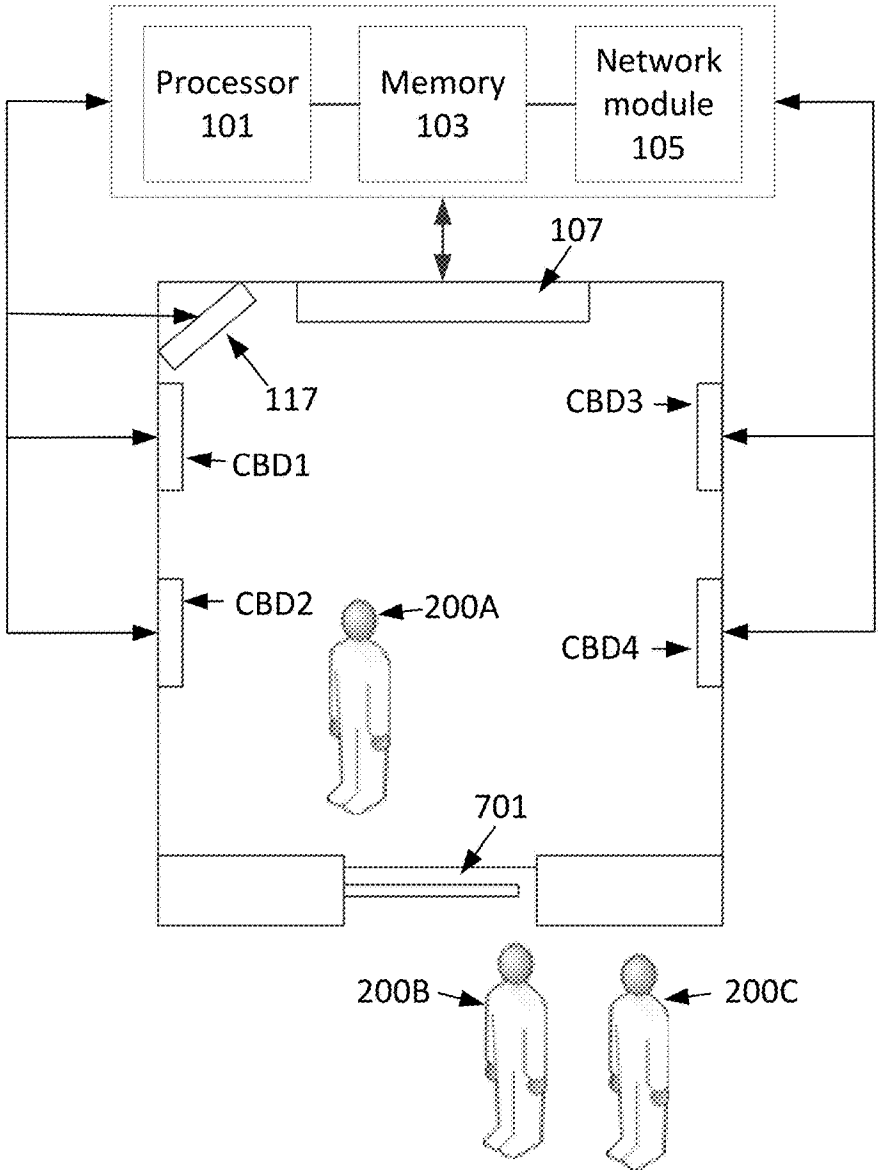
FIG. 7 is a sixth scenario for entering a locked system using arrays of CBDs arranged along multiple walls, according to one exemplary aspect of the present disclosure.

FIG. 7 shows another example of a configuration that can accommodate multiple users. Arrays of CBDs can be placed along both walls leading up to the door 107. A system such as a rotating gate or turnstile 701 can be used so that users can walk up to the door 107 in smaller, less crowded numbers. Further, if the number of users near the door 107 is too great, the rotating gate or turnstile 701 can temporarily lock. Lastly, the display 117 can be used for providing information to users, such as whether a user is authorized to enter or not. In the case that a user is prevented from entering, feedback from the display 117 can let nearby users act accordingly (e.g. stay away from the door, call security).

Figure 8:
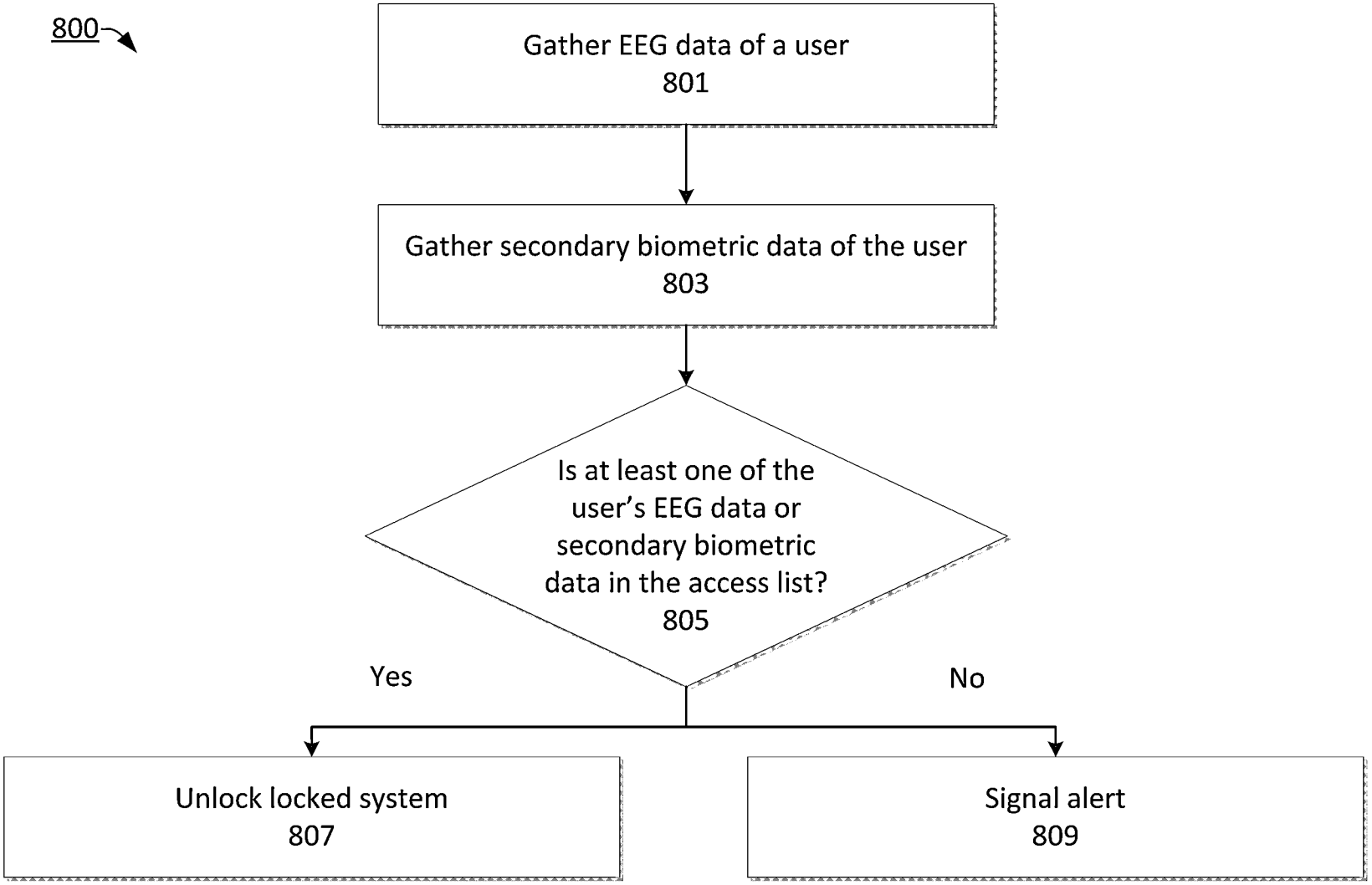
FIG. 8 is a first method for determining access, according to one exemplary aspect of the present disclosure.

It can be appreciated that the above mentioned techniques can be viewed as a method. FIG. 8 is an algorithmic flowchart of a method 800 according to one exemplary embodiment of the present disclosure.

Step 801 is gathering EEG data of a user using one or more CBDs. As described above, the CBDs can be arranged to effectively collect EEG waves emitted from the user. In one embodiment, the user can think of a password, such as a repetitive phrase, task, mathematical equation, or image to generate their unique EEG signature. In one embodiment, the display 117 can be used to generate the EEG data related to the password. The display 117 can show one or more images to the user to trigger an EEG signature.

Step 803 is gathering secondary biometric data of the user using one or more sensors. In one embodiment, the secondary biometric data is gait data, and the one or more sensors includes at least one of the imaging sensor 111, distance sensor 113, and pressure sensor 115. In another embodiment, an alternative or additional biometric can be used, such as facial recognition, fingerprints, finger geometry (the size and position of fingers), iris recognition, vein recognition, retina scanning, voice recognition, DNA (deoxyribonucleic acid) matching, digital signatures, smell, height, weight, or behavioral profiling. For example, a fingerprint sensor can be used for sensing fingerprints.

Step 805 is determining whether the user is in an access list using at least one of the EEG data and secondary biometric data. In one embodiment, a user is determined to be in the access list if both the EEG data and secondary biometric data match pre-registered EEG data and pre-registered secondary biometric data of a user profile in the access list. In another embodiment, a user is determined to be in the access list if either the EEG data or the secondary biometric data match pre-registered EEG data or pre-registered secondary biometric data of a user profile in the access list. The access list includes pre-registered EEG and pre-registered secondary biometric data of authorized users, which can be matched to the gathered EEG data and secondary biometric data of the user if they are authorized. Therefore, authorized users can have their EEG password and secondary biometric data collected beforehand, and stored in the access list for subsequent matching.

If it is determined from step 805 that the user is in the access list, step 807 is to unlock a locked system, such as a door. If it is determined from step 805 that the user is not in the access list, step 809 is to signal an alert. For instance, an auditory or visual signal can be emitted via the display 117 notifying the user that they have been denied access. In step 809, the locked system remains locked.

In another embodiment, rather than signaling an alert, step 809 can be to do nothing. The locked system can remain locked, and the user can reattempt to unlock the locked system if they desire.

Figure 9:
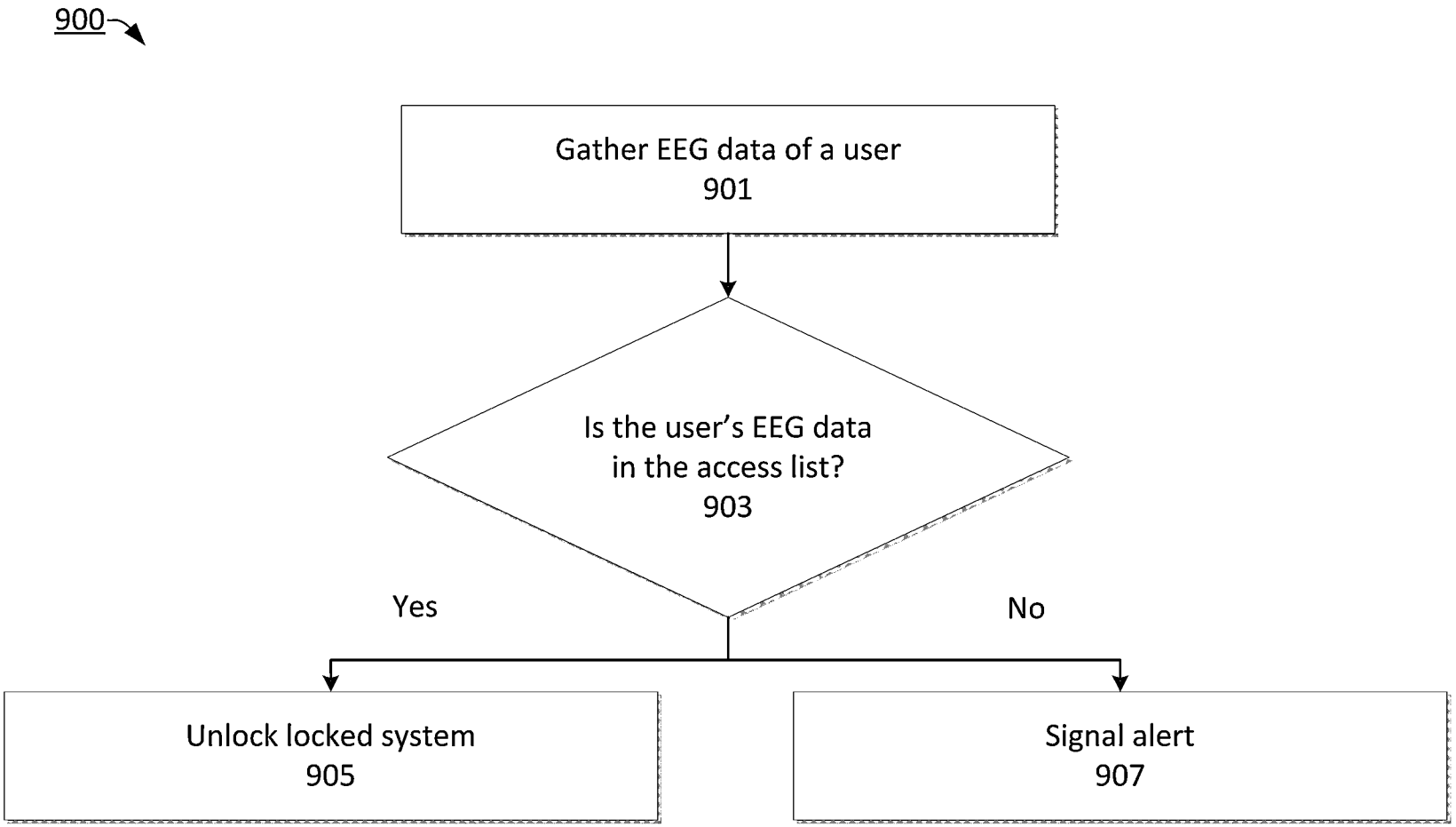
FIG. 9 is a second method for determining access, according to one exemplary aspect of the present disclosure.

FIG. 9 is an algorithmic flowchart of another method 900. Method 900 is similar to method 800 except secondary biometric data is not used. The first step 901 is gathering EEG data using one or more CBDs. Step 903 is determining whether the user's EEG data collected in step 901 is in an access list. If it is, step 905 is to unlock a locked system. If not, step 907 is to signal an alert.

Figure 10:
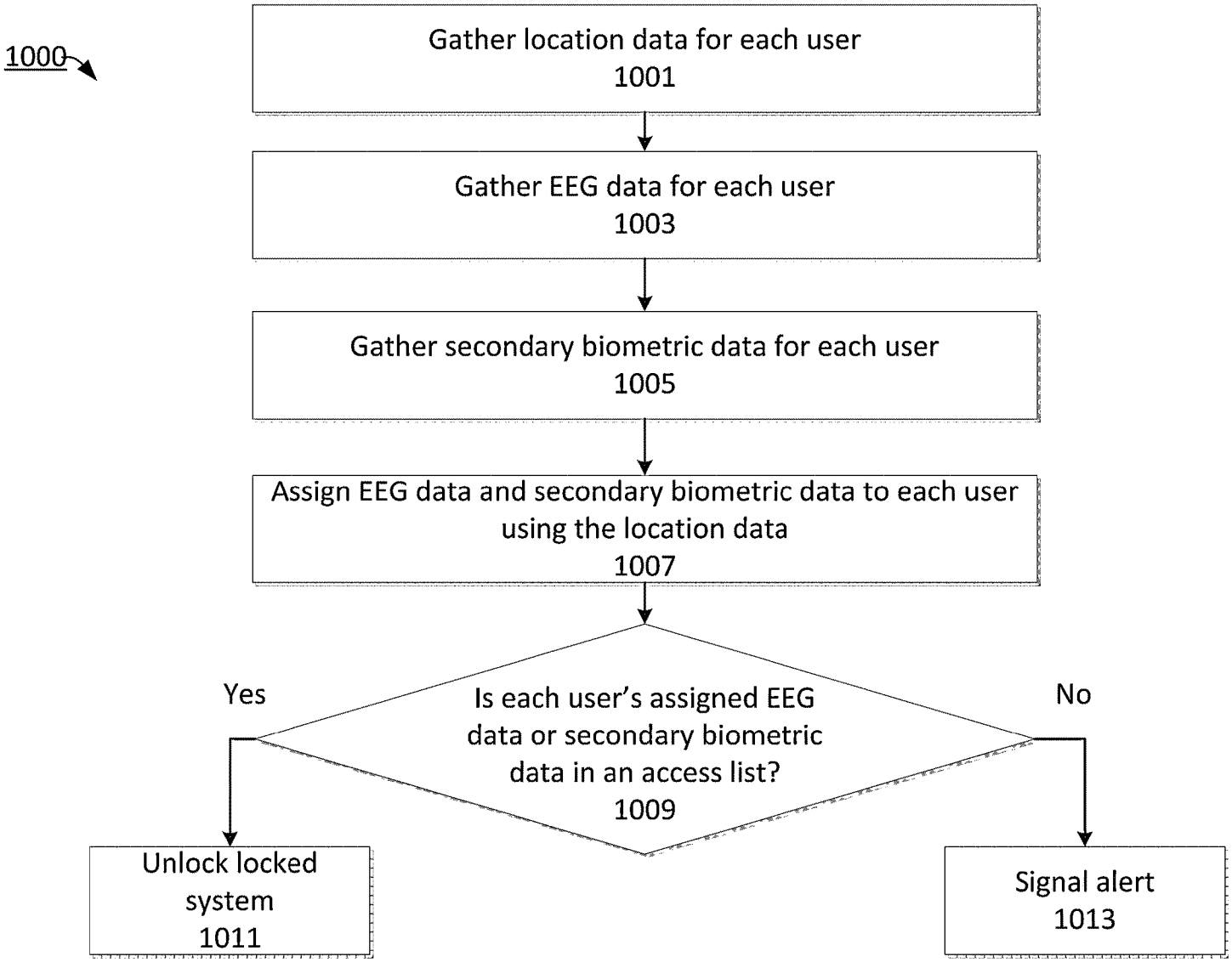
FIG. 10 is a third method for determining access, according to one exemplary aspect of the present disclosure.

FIG. 10 is an algorithmic flowchart of another method 1000. Step 1001 is gathering location data from each user of a plurality of users using one or more sensors. Essentially, this location data is related to the location of each user. For example, if there are two users, the location data can indicate the locations of the two users. The one or more sensors can include an imaging sensor 111, distance sensor 113, and pressure sensor 115.

Step 1003 is gathering EEG data from each user of the plurality of users using one or more CBDs. The CBDs can be arranged in a variety of ways as previously discussed, such as near a door, on one or more walls, or on a ceiling. Because each user will generate their unique EEG data, the EEG data generated by each user is gathered. For example, if there are two users, two sets of EEG data are gathered.

Step 1005 is gathering secondary biometric data for each user of the plurality of users using the one or more sensors. In one embodiment, the secondary biometric data is related to each user's gait. Because each user will generate their own secondary biometric data, the secondary biometric data generated by each user is gathered. For example, if there are two users, two sets of secondary biometric data are gathered. If gait data is collected, the one or more sensors can include an imaging sensor 111, distance sensor 113, and pressure sensor 115. If a different biometric is gathered, an appropriate sensor can be used (e.g. fingerprint sensor for collecting fingerprints).

As can be appreciated by one of skill in the art, the order of performing steps 1001, 1003, and 1005 can be interchanged in separate embodiments.

Step 1007 is assigning each of the EEG data and each of the secondary biometric data to each user of the plurality of users using the location data. For example, if there are two users, each user will be assigned their corresponding EEG data and secondary biometric data. The location data is useful because the closer a user is to a CBD, the stronger their EEG signal is. As an example, if a first EEG signal is stronger than a second EEG signal, the first EEG signal can be assigned to the user located closer to the CDB that detected the first EEG signal.

Step 1009 is determining, based on the assigning from step 1007, whether each of the plurality of users is in an access list. The access list includes pre-registered EEG data and pre-registered secondary biometric data of all users authorized to unlock a locked system. In the case that a number of the plurality of users determined to be in the access list exceeds a predetermined threshold (e.g. at least one user, 100% of users), step 1011 is unlocking the locked system. If the number of users determined to be in the access list does not exceed a predetermined threshold, step 1013 is to signal an alert. In step 1013, the locked system remains locked.

There are several use cases for the embodiments mentioned herein. In one embodiment, the techniques can be implemented into systems requiring unlocking. For example, the techniques can be used to allow access into a room or building. As another example, the techniques can be used to allow access into a vehicle.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

Embodiments of the present disclosure may also be as set forth in the following parentheticals.

(1) An access control method comprising: gathering electroencephalogram (EEG) data of a user using one or more brainwave detectors; gathering secondary biometric data of the user using one or more sensors; determining whether the user is in an access list using at least one of the EEG data and the secondary biometric data, wherein the access list includes pre-registered EEG data and pre-registered secondary biometric data of authorized users that can unlock a locked system, and wherein the user is in the access list if at least one of the EEG data and the secondary biometric data match the pre-registered EEG data and the pre-registered secondary biometric data of an authorized user; and in a case that the user is in the access list, unlocking the locked system.

(2) The method (1), further comprising: showing the user one or more images to generate the EEG data.

(3) The method of any (1) to (2), further comprising: in a case that the user is not in the access list, signaling an alert.

(4) The method of any (1) to (3), wherein the brainwave detectors are contactless brainwave detectors.

(5) The method of any (1) to (4), wherein the secondary biometric data includes gait data of the user's gait.

(6) The method of any (1) to (5), wherein the one or more sensors includes at least one of a fingerprint sensor, pressure sensor, imaging sensor, and distance sensor.

(7) The method of any (1) to (6), wherein the locked system includes a door.

(8) The method of any (1) to (7) wherein the locked system includes a door and the one or more brainwave detectors are placed adjacent to the door.

(9) The method of any (1) to (8), wherein the locked system includes a door and the one or more brainwave detectors are placed on one or more walls or ceilings leading up to the door.

(10) A locked system comprising: processing circuitry configured to gather EEG data of a user using one or more brainwave detectors, gather secondary biometric data of the user using one or more sensors, determine whether the user is in an access list using at least one of the secondary biometric data and the EEG data, wherein the access list includes pre-registered EEG data and pre-registered secondary biometric data of authorized users that can unlock the locked system, and wherein the user is in the access list if at least one of the EEG data and the secondary biometric data match the pre-registered EEG data and the pre-registered secondary biometric data of an authorized user, and in a case that the user is in the access list, unlock the locked system.

(11) The system of (10), wherein the processing circuitry is further configured to show the user one or more images to generate the EEG data.

(12) The system of any (10) to (11), wherein the processing circuitry is further configured to, in a case that the user is not in the access list, signal an alert.

(13) The system of any (10) to (12), wherein the brainwave detectors are contactless brainwave detectors.

(14) The system of any (10) to (13), wherein the secondary biometric data includes gait data of the user's gait.

(15) The system of any (10 to (14), wherein the one or more sensors includes at least one of a fingerprint sensor, pressure sensor, imaging sensor, and distance sensor.

(16) The system of any (10) to (15), wherein the locked system includes a door.

(17) The system of any (10) to (16), wherein the locked system includes a door and the one or more brainwave detectors are placed adjacent to the door.

(18) The system of any (10) to (17), wherein the locked system includes a door and the one or more brainwave detectors are placed on one or more walls or ceilings leading up to the door.

(19) An access control method comprising: gathering location data from each user of a plurality of users using one or more sensors; gathering EEG data from each user of the plurality of users using one or more contactless brainwave detectors; gathering secondary biometric data from each user of the plurality of users using the one or more sensors; and assigning each of the EEG data and each of the secondary biometric data to each user of the plurality of users using the location data.

(20) The method of (19), further comprising: determining, based on the assigning, whether each of the plurality of users is in an access list, wherein the access list includes pre-registered EEG data and pre-registered secondary biometric data of authorized users that can unlock a locked system, and wherein a user from the plurality of users is determined to be in the access list if at least one of the EEG data and the secondary biometric data gathered from the user match the pre-registered EEG data and the pre-registered secondary biometric data of an authorized user; and in a case that a number of the plurality of users determined to be in the access list exceeds a predetermined threshold, unlocking the locked system.

The invention claimed is:

1. An access control method comprising:

gathering electroencephalogram (EEG) data of a user using an array of a plurality of brainwave detectors, wherein the array of the plurality of brainwave detectors is positioned on one or more walls leading up to a door of a locked system, and wherein the plurality of brainwave detectors in the array are separated from each other by a predetermined distance and are configured to collect separate portions of the EEG data;

gathering secondary biometric data of the user using one or more sensors;

determining whether the user is in an access list using at least one of the EEG data and the secondary biometric data, wherein the access list includes pre-registered EEG data and pre-registered secondary biometric data of authorized users that can unlock the locked system, and wherein the user is in the access list if at least one of the EEG data and the secondary biometric data match the pre-registered EEG data and the pre-registered secondary biometric data of an authorized user; and in a case that the user is in the access list, unlocking the locked system.

2. The method of claim 1, further comprising:

showing the user one or more images to generate the EEG data.

3. The method of claim 1, further comprising:

in a case that the user is not in the access list, signaling an alert.

4. The method of claim 1, wherein the brainwave detectors are contactless brainwave detectors.

5. The method of claim 1, wherein the secondary biometric data includes gait data of the user's gait.

6. The method of claim 1, wherein the one or more sensors includes at least one of a fingerprint sensor, pressure sensor, imaging sensor, and distance sensor.

7. The method of claim 1, wherein the array of the plurality of brainwave detectors includes a first brainwave detector configured to collect a first portion of the EEG data, a second brainwave detector configured to collect a second portion of the EEG data, a third brainwave detector configured to collect a third portion of the EEG data, and a fourth brainwave detector configured to collect a fourth portion of the EEG data, and wherein the method further includes:

serially combining the first, second, third, and fourth portions of the EEG data to generate a serially combined EEG data signature, and comparing the serially combined EEG data signature to a stored EEG signature profile in the access list.

8. A locked system comprising:

processing circuitry configured to gather EEG data of a user using an array of a plurality of brainwave detectors, wherein the array of the plurality of brainwave detectors is positioned on one or more walls leading up to a door of the locked system, and wherein the plurality of brainwave detectors in the array are separated from each other by a predetermined distance and are configured to collect separate portions of the EEG data, gather secondary biometric data of the user using one or more sensors, determine whether the user is in an access list using at least one of the secondary biometric data and the EEG data, wherein the access list includes pre-registered EEG data and pre-registered secondary biometric data of authorized users that can unlock the locked system, and wherein the user is in the access list if at least one of the EEG data and the secondary biometric data match the pre-registered EEG data and the pre-registered secondary biometric data of an authorized user, and in a case that the user is in the access list, unlock the locked system.

9. The system of claim 8, wherein the processing circuitry is further configured to show the user one or more images to generate the EEG data.

10. The system of claim 8, wherein the processing circuitry is further configured to, in a case that the user is not in the access list, signal an alert.

11. The system of claim 8, wherein the brainwave detectors are contactless brainwave detectors.

12. The system of claim 8, wherein the secondary biometric data includes gait data of the user's gait.

13. The system of claim 8, wherein the one or more sensors includes at least one of a fingerprint sensor, pressure sensor, imaging sensor, and distance sensor.

14. An access control method comprising:

gathering location data from each user of a plurality of users using one or more sensors;

gathering electroencephalogram (EEG) data from each user of the plurality of users using an array of a plurality of contactless brainwave detectors, wherein the array of the plurality of contactless brainwave detectors are positioned on one or more walls leading up to a door of a locked system, and wherein the plurality of contactless brainwave detectors in the array are separated from each other by a predetermined distance and are configured to collect separate portions of the EEG data;

gathering secondary biometric data from each user of the plurality of users using the one or more sensors; and assigning each of the EEG data and each of the secondary biometric data to each user of the plurality of users using the location data.

15. The method of claim 14, further comprising:

determining, based on the assigning, whether each of the plurality of users is in an access list, wherein the access list includes pre-registered EEG data and pre-registered secondary biometric data of authorized users that can unlock the locked system, and wherein a user from the plurality of users is determined to be in the access list if at least one of the EEG data and the secondary biometric data gathered from the user match the pre-registered EEG data and the pre-registered secondary biometric data of an authorized user; and in a case that a number of the plurality of users determined to be in the access list exceeds a predetermined threshold, unlocking the locked system.

* * * * *